United States Patent [19]

Kuwahara

[11] 4,394,167

[45] Jul. 19, 1983

[54] METHOD OF CARBOTHERMICALLY PRODUCING ALUMINUM

[75] Inventor: Kenshi Kuwahara, Kanagawa, Japan

[73] Assignee: Mitsui Aluminum Co., Ltd., Tokyo, Japan

[21] Appl. No.: 241,053

[22] Filed: Mar. 6, 1981

[30] Foreign Application Priority Data

Apr. 22, 1980 [JP] Japan ..... 55-53374

[51] Int. Cl.[3] ..... C22B 21/02

[52] U.S. Cl. ..... 75/68 A

[58] Field of Search ..... 75/68 A

[56] References Cited

U.S. PATENT DOCUMENTS

| | | | |
|---|---|---|---|
| 3,234,008 | 2/1966 | Johnson | 75/68 A |
| 3,661,561 | 5/1972 | Frey, Jr. et al. | 75/68 A |
| 3,661,562 | 5/1972 | Seth et al. | 75/68 A |
| 3,836,357 | 9/1974 | Dewing | 75/68 A |
| 4,046,558 | 9/1977 | Das | 75/68 A |
| 4,053,303 | 10/1977 | Cochran et al. | 75/68 A |

*Primary Examiner*—M. J. Andrews

*Attorney, Agent, or Firm*—Armstrong, Nikaido, Marmelstein & Kubovcik

[57] ABSTRACT

A method of producing an aluminum metal from alumina, silica and iron oxide bearing materials by mixing the coal and bringing the mixtures to the temperature in the range of 600° to 900° C. in order to make the alumina bearing coked briquettes. Then, the coked briquettes are brought to the temperature in the range of 2,000° to 2,100° C. to produce aluminum, silicon and iron containing alloys. The alloys are scrubbed by molten lead spray directly after the alloys formation, and are converted to lead-aluminum alloy. An aluminum is separated from lead by liquation and purified by fractional distillation.

13 Claims, 1 Drawing Figure

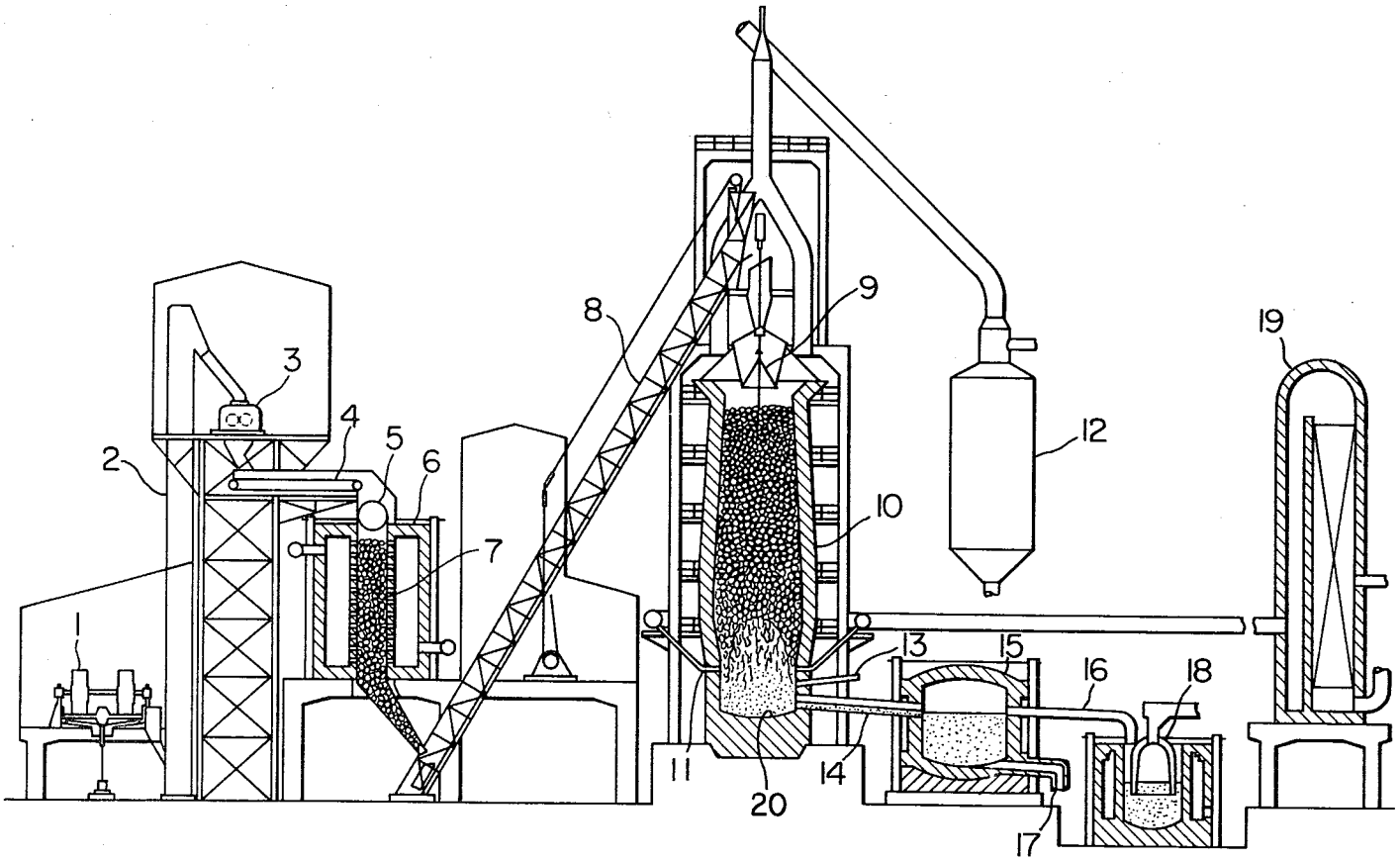
19
18
12
16
17
15
13
10
9
14
20
11
8
7
6
5
4
3
2
1

METHOD OF CARBOTHERMICALLY PRODUCING ALUMINUM

This invention relates to aluminum metal and, more particularly, to the carbothermic production of aluminum alloy and the separation of aluminum metal from the alloy thereof.

It is known that extensive research has been done relating to the carbothermic smelting of aluminum. P.T. Stroup published an article entitled "Carbothermic Smelting of Aluminum" in Transactions of the Metallurgical Society of AIME Volume 230, pages 356–371 (1964), which provides a history of the work done in the smelting of aluminum carbothermically.

There are examples of the commercial production of aluminum alloys, particularly of aluminum-silicon alloys, by carbon reduction using an electric arc furnace. However, aluminum of high purity comparable to the metal from the existing Hall-Heroult electrolytic smelting process has not yet been successfully produced.

Frederick W. Frey et al in U.S. Pat. Nos. 3,661,561 and 3,661,562 suggest a process for producing aluminum-silicon alloys in a blast furnance in which a charge containing carbon, an aluminum-silicon ore and pure oxygen and a furnace bed comprising lumps of silicon carbide are provided. Contrary to the disclosure of these patents, the form of the carbon and also the form of the mixed charge and their strength are very critical for blast furnace operation. A special feature of an iron blast furnace is the mass-production of pig-iron using lump coke of high strength in a vertical shaft furnace. The operating conditions of an aluminum blast furnace are far more severe than those of an iron blast furnace because of the higher temperature of alumina reduction. A coke is required which has sufficient strength so that it does not disintegrate due to the load in the shaft furnace and which makes it possible to maintain good permeability for an ascending stream of gas by maintaining a lump coke zone.

Subodh K. Das et al in U.S. Pat. No. 4,046,558 disclose the carbothermic production of aluminum-silicon alloys from alumina and silica bearing materials, e.g. anorthosite and bauxite. In this process, the mix, which preferably is formed into briquettes, can be reduced in a blast furnace or electric furnace. For purposes of reduction and heating in a blast furnace, the mix should contain 55 to 90 wt % carbon. A briquette which is simply mixed with ore and coke will not have sufficient strength for a blast furnace operation and will disintegrate as it descends in the shaft and will block the flow of gas.

Cochran et al in U.S. Pat. No. 4,053,303 disclose a method of carbothermically producing aluminum-silicon alloys by bringing a mix containing sources of alumina, silica and carbon to a temperature in the range of 1500° to 1600° C. in a first stage, in the range of 1600° to 1900° C. in a second stage, and in the range of 1950° to 2200° C. in a third stage. Carbon monixide and other gaseous effluent formed in the first stage should be removed without passing through materials formed during the subsequent higher temperature treatment. Cochran et al suggest that the mix can be reduced in a blast furnace but nothing is mentioned as to how to carry out such an operation in the blast furnace.

In a modern blast furnace operation for the manufacturing of pig iron, it is the prevailing practice to use oxygen enriched air. The purpose of using the oxygen enriched air is to provide an increase of the temperature with a smaller amount of air and to promote the production efficiency of iron. Recent technological development of the iron blast furnace opens the road to increasing the temperature in a blast furnace high enough to produce an aluminum alloy by carbothermic reduction.

In view of this background it is an object of this invention to produce aluminum from alumina containing materials.

Another object of this invention is the carbothermic production of aluminum from ores having a low alumina content.

The method according to the present invention comprises providing as sources of alumina bearing materials clay, kaolinite, agalmatorite, bauxite, aluminous shale, and as a source of carbonaceous material a coking coal. The alumina bearing materials and coal are mixed and formed into briquettes. The briquettes are exposed directly to a non-oxidizing gas having a temperature in the range of 600° to 900° C. The time of coking is 20 to 50 minutes. The alumina containing coked briquettes are then reduced carbothermically in a blast furnace, which is quite similar to the modern blast furnace used in the manufacture of pig-iron. The metal product which is produced by the carbothermic reduction in the blast furnace contains aluminum, silicon and iron. It is scrubbed and adsorbed by a molten lead spray which is splashed into the furnace from a nozzle just under the tuyere level.

The metal products mixed with a large amount of lead are drawn out from the bottom of the blast furnace, and after settling in a liquation furnace to form two layers, the aluminum is tapped from the top of the liquation furnace and purified by fractional distillation.

BRIEF DESCRIPTION OF THE DRAWING

The drawing is a side view of a plant for carrying out the method of the present invention and includes a preparation plant, coker, blast furnace and purification unit.

In accordance with the method of the present invention, aluminum is carbothermically produced from alumina bearing materials by direct reduction with carbon in a blast furnace.

As noted above, extensive research has been carried out relating to the carbothermic reduction of alumina. The chemical reaction which occurs in the alumina reduction is known to be represented by the following equation:

$$Al_2O_3+3C=2Al+3CO \quad (1)$$

The reaction shown in equation (1) proceeds from left to right at a temperature of more than 2040° C., preferably at 2100° C. It is difficult to make aluminum ingot at such a high temperature because of vaporization and carbide formation.

In the case of the co-existence of the three components, alumina, silica and carbon, it is known that the chemical reactions proceed as follows according to stages of increasing temperature:

The first stage: 1200°–1900° C.

$$SiO_2+C=SiO+CO \quad (2)$$

$$SiO+2C=SiC+CO \quad (3)$$

$$SiO_2+2SiC=3Si+2CO \quad (4)$$

$$2Al_2O_3+3C=Al_4O_4C+2CO \quad (5)$$

The second stage: 1900°–2000° C.

$$SiO+SiC=2Si+CO \quad (6)$$

$$2Al_2O_3+9C=Al_4C_3+6CO \quad (7)$$

The third stage: 2000°–2100° C.

$$Al_4O_4C+Al_4C_3=8Al=4CO \quad (8)$$

$$2Al_4C_3+3SiO_2=8Al+3Si+6CO \quad (9)$$

$$Al_2O_3+3SiC=2Al+3Si+3CO \quad (10)$$

As is clearly known from the above equations, the reduction of alumina by carbon will form aluminum-oxycarbide (5) in the first stage, then aluminum-carbide (7), and finally will form the aluminum by the mutual reaction of aluminum-oxycarbide and aluminum-carbide as indicated by equation (8). In the temperature zone between 2000°–2100° C., aluminum and silicon are formed according to equations (9) and (10), and both components will combine together immediately and form aluminum-silicon alloys. In the case of the co-existence of iron-oxide in the system, the reduction of iron-oxide will begin at about 600° C. and be completed at about 1500° C., and aluminum-silicon-iron alloys will be formed.

As noted above, the production of aluminum-silicon alloys by the carbothermic reduction of alumina and silica bearing materials has been done in an electric arc furnace on a semi-commercial scale. However, the use of a blast furnace on a large scale for this purpose has not yet been successful.

In a conventional blast furnace operation, it is important to control the size distribution of particles of charging materials and to prevent blocking of the passage of upwardly flowing gas. When particle segregation of charging materials occurs, it disturbs the uniform proceeding of reactions in the blast furnace. Large particles will fall in the middle of the shaft, and small particles will fall in the periphery and, therefore, the gas will ascend in the middle of the shaft, and not in the periphery, and the stream of gas cannot exhibit uniform upward flow.

An aim of the present invention is to provide a method of manufacturing aluminum from alumina bearing materials by carbothermic reduction. The method of the invention comprises preparing briquettes which contain alumina, silica, and iron-oxide bearing materials and coal, and exposing the briquettes to a non-oxidizing gas having a temperature in the range of 600° to 900° C. in order to make alumina bearing coked briquettes. These coked briquettes are charged into a blast furnace, which is similar to the furnace employed in pig-iron manufacturing. Coked briquettes, charged at the top of the blast furnace in a hot state, descend in the shaft and are heated to a temperature of 2000° and 2100° C. at the tuyere level. The reduction reactions of alumina, silica and iron-oxide take place, and aluminum-silicon-iron alloys are produced. Molten lead is then splashed onto the produced droplets of the metal alloys, and the aluminum is absorbed by the lead.

The process of the present invention offers the possibility of using various raw materials, clay, kaolinite, bauxite, aluminous shale, agalmatorite and any other alumina containing materials. However, it is preferable to use alumina and silica at a mol-ratio of 1:1 and, more preferably, to use an excess of silica which is less than 2 Mol of silica compared with 1 Mol of alumina. In order to employ this ratio, it is the practice of the present invention to use commercial alumina or silica sand.

In the preparation step, coking coal in a pulverized form is employed. When the raw material has no binding power, it is preferable to add a small amount of binder, such as lime, calcium aluminate, or sulfite liquor. The mixture are thoroughly mixed and chased, and the chased mix is formed into briquettes. Then the briquettes are exposed to a non-oxidizing gas stream such as a stream of combustion products of blast furnace exit gas, of which the oxygen content is less than one percent, and of which the temperature is between 600° and 900° C. for a short period, for example, 20 to 50 minutes. This direct coking operation eliminates the volatile matter in the coal and produces an alumina bearing coked briquette which has a porous coked structure.

The present invention is carried out in a conventional blast furnace, but in which the charging material is composed of the alumina bearing coked briquette. The heating of the furnace is done using fuel oil, fuel gas or pulverized coke with oxygen enriched air, similar to the operation of the modern blast furnace operation used in the manufacture of pig-iron. A special feature of this invention comprises the charging of alumina-bearing coked briquettes in a hot state into the blast furnace directly after being discharged from a coker. It is not necessary to charge the ore and coke separately and alternately in the blast furnace.

In the blast furnace operation for the manufacture of iron, it is important to control the size distribution of charging materials such as iron ore and coke. In this invention, however, the charging materials have the same shape, the same size and the same porosity, and the resistance to the up-draft gas flow is essentially the same in every part of the furnace shaft. Furthermore, the coked briquettes have innumerable micro-pores in their coked structure, and large specific surface area.

The alumina bearing coked briquette has sufficient strength to resist the load and the abrasion that occurs during its descent in the furnace shaft, and will not disintegrate until it is in the fusion zone near the tuyere level of the furnace. Therefore, the ascending stream of furnace gas is carried uniformly and rapidly during the continuous operation of the blast furnace.

Table 1 shows a comparison of compression strength and specific surface area between a coked briquette which is formed in Example 1 of this invention, and a briquette made by simple press-forming of ore and coke.

TABLE 1

| Item | Coked briquette of this invention | Press-formed briquette of ore and coke mix | Note |
|---|---|---|---|
| Compression strength kg/sq.cm | 137 | 53 | Amsler test |
| Specific surface area $m^2$/gram | 48 | 20 | BET method |

In the present invention, the chemical reactions from the first stage equations (2), (3), (4) and (5) to the second stage equations (6) and (7) proceed continuously in the middle zone of the shaft, and the reactions of the third stage equations (8), (9) and (10) occur at the bottom zone near the tuyere level of the blast furnace.

In the invention, molten lead is splashed into the furnace at a level below the tuyere so as to contact droplets of the aluminum-silicon-iron alloys in a nascent state and to exchange heat between the high temperature alloys and the low temperature lead, and to form lead-aluminum alloys by absorbing the aluminum with the lead. The lead does not absorb the aluminum at 660° C., the melting point of the aluminum, but the solubility of aluminum in lead will reach 2% at 1200° C., and will be increased by increasing the temperature. The vapor pressure of lead is small and the volatilization loss of lead is negligible.

The molten lead alloys which contain aluminum are drawn out from the bottom of the blast furnace to the liquation pot. The lead which is settled in the bottom of the pot is drawn out for recycling to the blast furnace. The aluminum which is collected at the upper part of the liquation pot is tapped out for further purification treatment. A small amount of lead remaining in the aluminum is eliminated by fractional distillation under reduced pressure.

The attached drawing of this invention is explained in detail below.

Clay is crushed and mixed with coal in a flet mill 1 of conventional type. The mix is lifted up by elevator 2, and is fed to a briquetting machine 3. The green briquettes which come out from the briquetting machine are charged via an accumulator car 4 to the rotary hopper 5 of coker 6. The coker provides a coking chamber 7 in the middle of a furnace structure, the coking chamber having perforated refractory structures in both sides. Non-oxidizing gases such as combustion products of blast furnace exit gas pass through the column of green briquettes at a temperature of 600° to 900° C., and expel the volatile matter in the coal by direct contact with the gas. Alumina bearing coked briquettes of high strength and a porous structure are produced by the direct coking operation. It is preferable to select the time of coking treatment to be between 20 to 50 minutes. When the coking time is longer than 50 minutes, the fixed carbon in the coal mix will begin to burn and will cause a lowering of the strength of the coked briquettes accompanied with a loss of fixed carbon.

The red hot coked briquettes which come out from the coker are lifted up immediately at the top of the blast furnace by a skip hoist 8, and are charged to a blast furnace 10 through a bell 9 of a conventional type. The charged briquettes descend uniformly without any particle segregation. The air for combustion is blown into the furnace through a nozzle 11 which connects to a hot stove 19. The combustion waste gas is exhausted from the top of the furnace and reutilized via a dust collector 12.

The high temperature zone of 2000° to 2100° C. is provided at the tuyere level 11, and the charged materials are subjected to the final stage reduction reactions to produce aluminum-silicon-iron alloys which fall down to the metal bath crucible 20 at the bottom of the blast furnace. Molten lead is splashed in the furnace through a nozzle 13 which is installed between the tuyere level and the metal bath level, and droplets of the aluminum-silicon-iron alloys are absorbed in the lead and converted to an aluminum-lead alloy. This lead alloy is transferred to a liquation pot 15 through duct 14 from the metal bath crucible 20. The lead and aluminum are separated in two layers in the liquation pot, and the aluminum is tapped from the top through duct 16 to a vacuum distillation pot 18 and the lead is drawn from the bottom through duct 17. Silicon in the aluminum alloy is separated by the lead treatment. Iron in the alloy is also nearly perfectly rejected from the aluminum by the lead treatment.

The following examples are further illustrations of the invention.

EXAMPLE 1

IWATE clay of following compositions is used as the raw material of this process.

| | Wt. % |
|---|---|
| $Al_2O_3$ | 34.14 |
| $SiO_2$ | 46.68 |
| $Fe_2O_3$ | 4.74 |

In this case, the silica content is high. Alumina of a commercial grade is added in order to adjust the molecular weight ratio of the silica to a 50% excess of that of the alumina. The mixing proportion of the materials is as follows:

| | Weight parts |
|---|---|
| IWATE clay | 43.5 |
| Alumina | 8.7 |
| Coking coal | 47.8 |
| Recycling charge | 8.7 |
| total | 108.7 |

Each of the materials are crushed and passed through No. 10 meshes of a Tyler-screen, and mixed in a flet mill. A small percentage of calcium-aluminate is added as a binding material, and after thorough chasing, the mixture is transferred to the briquetting machine. The size of the briquette is 110 mm. in length, 75 mm. in width, 65 mm. in thickness in a pillow shape and the weight of each briquette is about 500 grams. The briquettes are charged to the coking chamber, and a combustion gas having a temperature of 800° C. is passed through the column of briquettes. The volatile matter in the coal mix is completely expelled by direct contact with the hot gas stream for 30 minutes and forms alumina bearing coked briquettes which have numerous micro-pores. The strength of this coked briquette is 137 kg per square-centimeter measured by an Amsler compression testing machine. The bulk density of this coked briquette is 1.3 and its weight of filling is 845 kg per cubic meter and its void ratio in the furnace room is 35%. Therefore, a modern blast furnace of inner volume 4000 cubic meter can hold nearly 3,400 tons of coked briquettes.

The hot coked briquettes are charged to the top of the blast furnace and after descending in the shaft are heated to a temperature of 2000° to 2100° C. at the tuyere level. Molten lead is splashed into the furnace under the level of the tuyere and absorbs the aluminum converting it into the lead-aluminum alloy. The lead alloy is drawn from the bottom of the blast furnace to the liquation pot. After settling several hours, the aluminum is tapped from the top layer and is subjected to a purification treatment by fractional distillation under reduced pressure. The aluminum metal which is recovered in this example is 10 parts from 100 parts of coked briquettes.

EXAMPLE 2

HOOTOKU clay of the following composition is used as the raw material of this process.

| | wt % |
|---|---|
| $Al_2O_3$ | 27.96 |
| $SiO_2$ | 54.82 |
| $Fe_2O_3$ | 1.76 |

In this case, the silica content is very high and a commercial grade of alumina is added in order to adjust the mol-ratio of silica to alumina to a 40% excess. The mixing proportion of the materials is as follows:

| | Weight parts |
|---|---|
| HOOTOKU clay | 37.0 |
| Alumina | 14.8 |
| Coking coal | 48.2 |
| Recycling charge | 9.3 |
| total | 109.3 |

The mixed materials are treated in the manner of Example 1, and 10.5 parts of aluminum metal is recovered from 100 parts of coked briquettes.

Table 2 shows a comparison of the purity of aluminum metal which is recovered by this process, and aluminum metal produced by the Hall-Heroult process.

TABLE 2

| Composition | Aluminum metal by this blast furnace process | Aluminum metal by existing Hall-Heroult electrolytic process |
|---|---|---|
| Al | >99.0 | >99.0 |
| Si | 0.04 | 0.04 |
| Fe | 0.03 | 0.16 |
| Pb | 0.02 | 0.00 |

I claim:

1. A method of carbothermically producing an aluminum metal from alumina, silica and iron-oxide bearing materials, which comprises;

(a) providing briquettes of a mix of said materials and a carbonaceous material which contains a sufficient amount of carbon to reduce the oxides in the material and coking said briquettes at a temperature of 600° to 900° C. by direct contact with non-oxidizing gas, to form coked briquettes, (b) heating the coked briquettes to a temperature of 2,000° to 2,100° C. with gas for combustion to form an aluminum-silicon-iron alloy, (c) scrubbing the resulting alloy in the nascent state with a molten lead splash to preferentially absorb the aluminum in the alloy into the molten lead, (d) separating the silicon and iron of the alloy from the aluminum-absorbed molten lead, (e) cooling the aluminum-absorbed molten lead to cause it to separate into liquid layers of aluminum and lead, respectively, and (f) subjecting the aluminum layer to distillation to distill off lead present and recover aluminum metal in substantially pure form.

2. The method of claim 1 wherein the coking step (a) is effected in a coking furnace.

3. The method of claim 2 wherein the heating step (b) is effected in a blast furnace.

4. The method of claim 3 wherein the scrubbing step (c) is effected by splashing the molten lead under the tuyere level in the bottom of the blast furnace.

5. The method of claim 4 wherein the cooling step (d) is effected in a liquation pot located adjacent to the blast furnace.

6. The method of claim 5 wherein the distillation step (e) is effected in a separate pot located adjacent to the liquation pot.

7. The method of claim 6 wherein the distillation is carried out under reduced pressure.

8. The method of any one of claims 1–7 wherein the carbonaceous material is a coking coal.

9. The method of claim 8 wherein the non-oxidizing gas contains less than 1% by weight of oxygen.

10. The method of claim 8 wherein the coking is carried out for 20–50 minutes.

11. The method of claim 8 wherein said mix contains carbon in an amount of 35–50 wt.% in the form of coking coal.

12. The method of claim 8 wherein said mix contains silica and alumina in a molecular weight ratio in the range of 1:1 to 2:1.

13. The method of claim 8 wherein the alumina bearing material is selected from the group consisting of clay, kaolinite, agalmatorite, aluminous shale and bauxite.

* * * * *